US006318506B1

(12) United States Patent
Marté et al.

(10) Patent No.: US 6,318,506 B1
(45) Date of Patent: Nov. 20, 2001

(54) SINGLE ROPE ELEVATOR GOVERNOR

(75) Inventors: Luis Marté, Madrid; Andres Monzón, Leganés; Emilio Fernández-Salinero, Madrid, all of (ES)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/577,069

(22) Filed: May 22, 2000

(51) Int. Cl.[7] ..... B66B 5/12
(52) U.S. Cl. ..... 187/373; 188/188
(58) Field of Search ..... 187/373, 374, 187/375, 376; 188/180, 188, 189

(56) References Cited

U.S. PATENT DOCUMENTS 1,242,394 * 10/1917 Venn .
5,183,979 * 2/1993 Sheridan et al. ..... 187/108
5,458,216 * 10/1995 Tanaka et al. ..... 187/373
5,617,933 4/1997 Ericson .

* cited by examiner

*Primary Examiner*—Thomas J. Brahan
(74) *Attorney, Agent, or Firm*—Wall Marjama & Bilinski

(57) ABSTRACT

An elevator system that includes a cab unit is connected by a hoisting system to a counterweight unit so that both units move at the same speed over vertical rails. A single governor rope is trained in an endless loop between an upper drive sheave and a lower tensioning sheave so that a pair of vertically disposed parallel runs of rope pass between the units. A bidirectional governor brake is arranged to retard the ropes speed when an over speed condition is encountered. Safeties associated with both units are connected to the opposite runs of the governor rope and are tripped when the governor rope is braked.

8 Claims, 5 Drawing Sheets

SINGLE ROPE ELEVATOR GOVERNOR

FIELD OF THE INVENTION

This invention relates generally to elevator safety systems, and in particular to a governor for sensing an over speed condition in an elevator system.

BACKGROUND OF THE INVENTION

A typical traction elevator system used in buildings includes a cab that is supported upon a hoist rope. The hoist rope, in turn, is passed over a motor driven drive sheave and the other end of the rope is connected to a counterweight. As the drive sheave is turned, the cab unit and the counterweight unit move vertically along guide rails in opposite directions. The counterweight generally has a weight equal to that of the cab unit plus some additional weight which is a percentage of the cab's rated load capacity.

Safety systems are installed to prevent potentially dangerous over speeding of the cab. To this end, safety units, generally referred to as "safeties", are provided to bring the cab to a controlled halt any time an over speed condition is detected. Safeties generally employ clamps, wedges, rollers or combinations thereof that apply a holding force against the guide rails of the cab unit and/or the counterweight unit to bring the cab to a rapid, safe halt.

In most cases, a governor is used to sense the occurrence of an over speed condition and take some type of responsive action to activate the safeties on both the cab unit and the counterweight unit. As shown in FIG. 1, the governor unit 10 that is in wide use today, includes a pair of governor ropes 11, 13, one of which is connected to the elevator cab 12 and the other of which is attached to the counterweight unit 14. Each governor rope passes over an upper sheave 15, 16 and a lower sheave 17,18 to create a pair of endless loops. Weights 19 and 10 are suspended from the lower sheaves which serve to tension the associated governor rope and maintain the opposed runs of each governor rope in parallel alignment. The governor ropes are connected in a well known manner with safeties 22 associated with each of the units. A governor brake 24 is associated with each governor unit which is adapted to engage the governor rope when the speed of the rope exceeds a given velocity. An over speed condition may be detected by flyweights or electrical sensors which activate the governor brake slowing the governor rope down. This, in turn, trips the unit safeties bringing the elevator to a halt.

This type of prior art governor works extremely well in practice, as evidenced by the safety record of traction elevators. However, as should be evident from the disclosure above, the system requires a separate governor rope for both the cab unit and the counterweight unit. This, in turn, is space consuming, increases installation and maintenance time, and increases the overall cost of the system.

SUMMARY OF THE INVENTION

It is a primary object of the present invention to improve traction elevator systems.

It is a further object of the present invention to improve governors employed in elevator systems.

A still further object of the present invention is to reduce the number of component needed in as elevator governor.

Another object of the present invention is to provide an elevator governor that requires only a single governor rope for sensing an over speed condition and activating the safeties on both the cab unit and counter weight unit of the system.

Yet another object of the present invention is to reduce the amount of space an elevator governor requires within a hoist way.

These and other objects of the invention are attained in an elevator system having a cab unit that is movably suspended between a first pair of guide rails that is connected by a hoist rope to a counter weight unit that is movably suspended between a second pair of guide rails. Safeties are mounted upon both units which are adapted to brake against the guide rails when an over speed condition is detected. A single governor rope is trained in an endless loop over an upper sheave and a lower tensioning sheave so that two parallel vertically disposed runs of rope pass between the two units. The rope is attached to one of the units so that it travels of the same speed as the units. A bidirectional governor brake is operatively associated with the upper sheave of the governor rope for applying a braking force to the rope in the event an over speed condition is encountered. Safety actuators in the form of lever arms are connected to the governor rope which are arranged to trip the safeties when the governor rope is braked to bring the elevator cab to a rapid and safe halt.

BRIEF DESCRIPTION OF THE DRAWING

For a further understanding of these and objects of the invention, reference will be made to the following detailed description of the invention which is to be read in connection with the accompanying drawing, wherein.

DETAILED DESCRIPTION OF THE INVENTION

Figure 1:
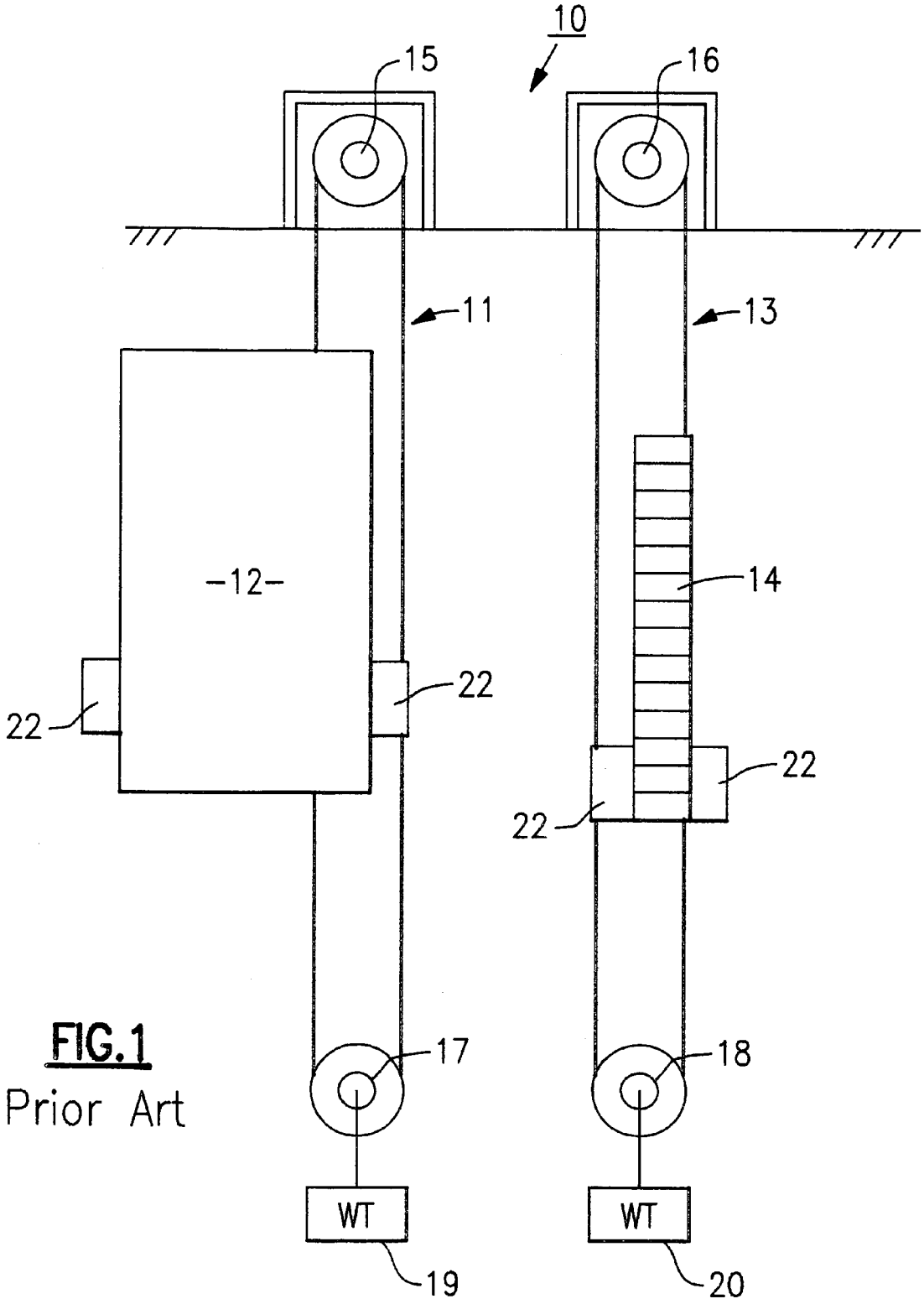
FIG. 1 Prior Art
FIG. 1 is a schematic representation of a typical elevator system found in the prior art employing two separate governor units.
Figure 2:
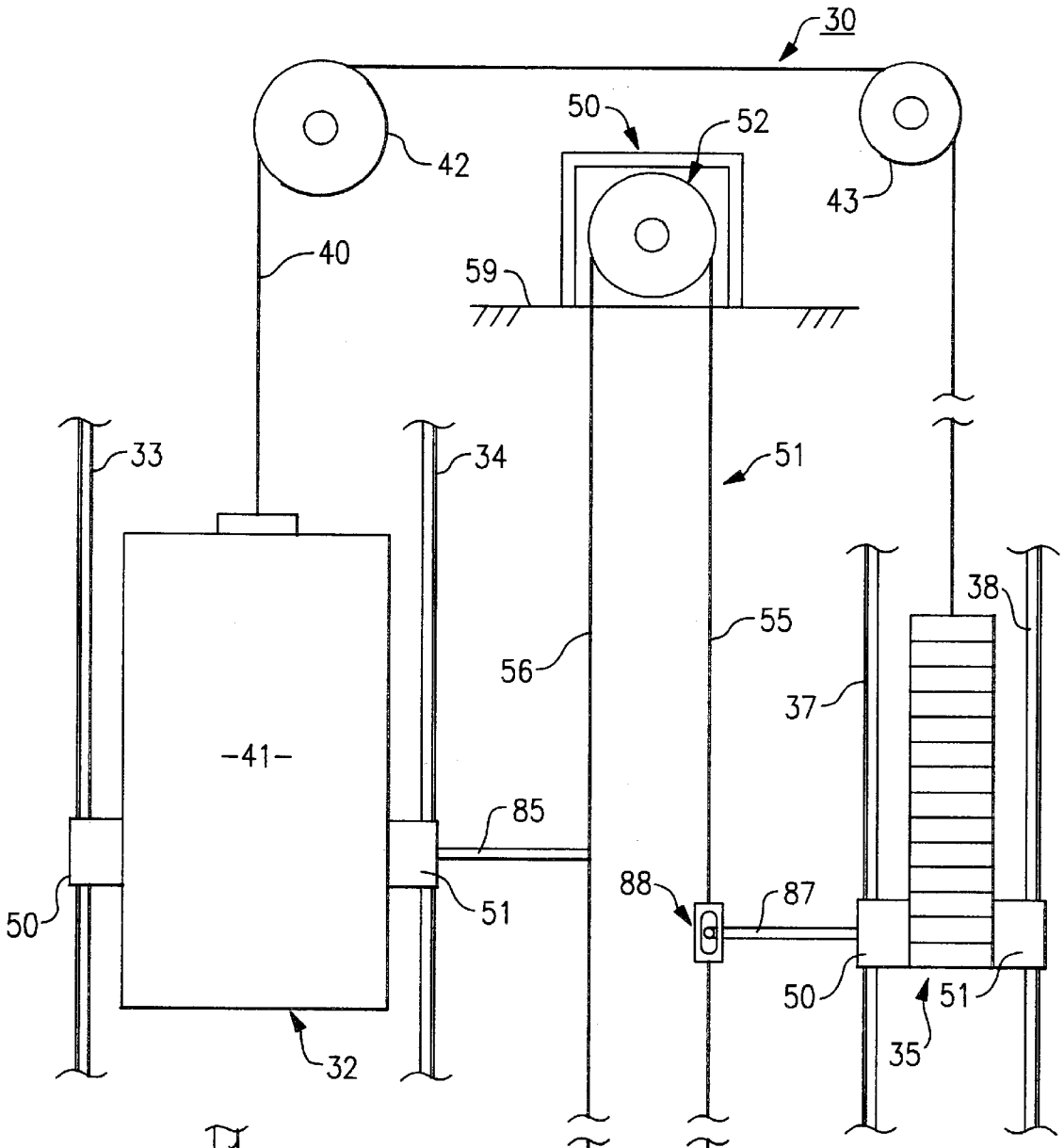
FIG. 2 is a schematic drawing showing an elevator system embodying the teachings of the present invention.
Figure 3:
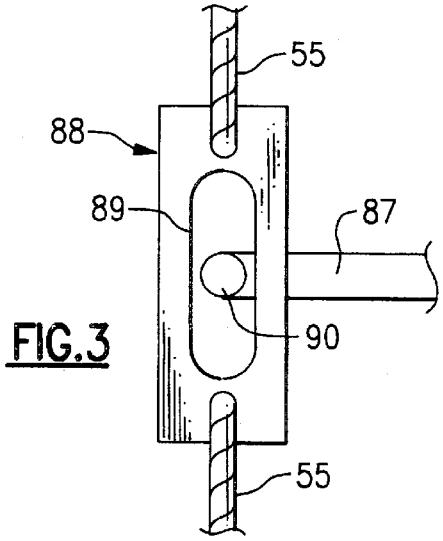
FIG. 3 is a partial view of a link used to attach the governor rope of the present invention to the safeties of the counter weight unit.

Referring now to FIGS. 2 and 3, there is illustrated an elevator system, generally referenced 30, that embodies the teachings of the present invention. The system includes a cab unit 32 that is suspended within the hoist way between a pair of spaced apart vertically disposed guide rails 33 and 34. A counterweight unit 35 is similarly mounted between a second pair of guide rails 37 and 38. One end of a hoist rope 40 is attached to the cab 41 and is passed over a drive sheave 42 and an idler pulley 43 with the other end of the rope being connected to the weights 45 of the counterweight unit. The drive sheave is connected to an electrical motor (not shown) which is capable of lifting the cab at relatively high speeds.

As will be explained in greater detail below, each unit is equipped with a pair of safeties 50 and 51 which are adapted to engage the associated rails when the governor 50 sent over speed condition. As is well known in the art, the safeties are designed to bring the cab to a rapid, safe stop.

Unlike the more conventional governor systems, the present governor employs a single drop 51. The governor rope is trained over an upper governor sheave 52 and a lower ion sheave 53 to establish two vertically disposed parallel runs 55, 56 of rope that pass between the cab unit and the counterweight unit. A weight 58 may be hung from the tension sheave to keep the runs in parallel alignment or alternatively the tension sheave may be held in a desired position by means of a suitable mounting bracket.

A bidirectional upper governor sheave employing a brake of the type described in U.S. Pat. No. 5,617,933 to Ericson is employed in the practice of the present invention. However, it should be clear to one skilled in the art that any suitable bi-directional brake can be employed in the practice of the present invention. The disclosure in the Ericson patent is incorporated herein by reference. The upper sheave 52 is rotatably supported in frame 55 having a pair of spaced apart vertically disposed side wall 56 and 57 that are integral with the base 58. The base is secured to the floor 59 of the machine room by any suitable means. A U-shaped bracket 61 is rotatably mounted inside the frame in as inverted position. The bracket includes a pair of opposed arms 63 and 64 that are conjoined by a cross member 65. The axis of rotation 67 of the bracket is vertically aligned with the axis of rotation 68 of the sheave and is raised above the axis of rotation of the sheave within the frame.

A friction brake assembly 70 is secured in the midsection of the cross member over the sheave groove 71. The brake assembly is equipped with a friction brake pad 73 that is arranged to move into friction contact with governor rope when the bracket is rotated out of its vertical home position in either a clockwise or counter clockwise direction. The frame is held in the vertical home position by an urged pair of detent pins 74. Each pin has a conical shaped head 75 at its distal end that is wedged into a complimentary axially aligned groove formed in the bracket by a biasing spring 76.

Figure 6:
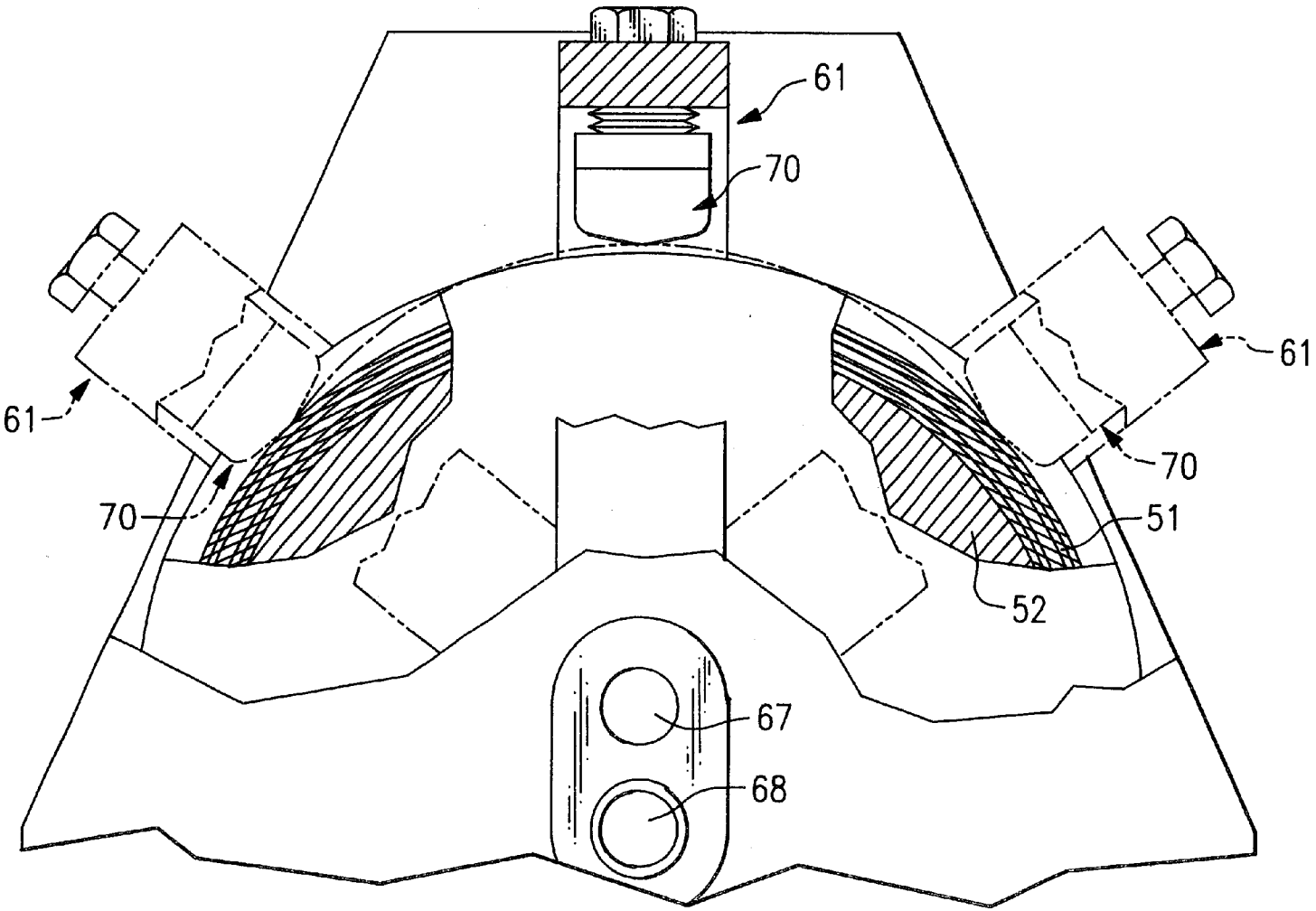
FIG. 6 is a further enlarged partial side view with portions broken away showing the bidirectional sheave illustrated in FIG. 5.

Flyweights 78 are rotatably mounted on one side wall 79 of the sheave 52. When the sheave reaches a given angular velocity indicative of an over speed condition, the flyweights extend outwardly beyond the rim of the sheave and contact a arm 80 attached to the frame with sufficient force to move the detent pin back against the spring and thus release the bracket. As best illustrated in FIG. 6, the bracket car swing in either direction depending on the direction of rotation of the sheave whereupon the brake moves into friction drawing contact with the governor rope to slow down the movement of the governor. Accordingly, the sheave, through the flyweights has the ability to sense an over speed condition in either direction and, in response thereto, brake the governor regardless of the direction of rotation of the sheave.

Referring once again to FIG. 2 the safeties 50 and 51 associated with the cab 41 are attached to one run 56 of the governor rope by means of an operating lever arm 85 that is associated with a trip linkage (not shown) of well known design. When the governor rope is slowed down a speed difference is produced between the cab and the governor rope. This in turn, causes the lever arm to be displaced thereby activating the safeties on the cab. The lever arm 87 associated with the safeties on the counterweight unit is similarly displaced at this time to activate the safeties associated with counterweight unit bringing the cab to a rapid and safe halt.

As illustrated in FIG. 3 a link 88 is tied into run 55 of the governor rope and is arrange to engage the lever arm 87 associated with the counterweight unit. The link contains an elongated slotted hole 89 that is coaxially aligned with the governor rope. The distal end of lever arm 87 is bent to form a 90° angle with the body of the arm and the distal end of the arm is passed through the slotted hole in the link. This, in turn, establishes a predetermined amount of lost motion between the rope and the lever arm. This lost motion accommodates for any elongation in the rope that might otherwise adversely effect the operation of the governor. The link further serves to keep tension on the generator rope under all conditions.

Figure 4:
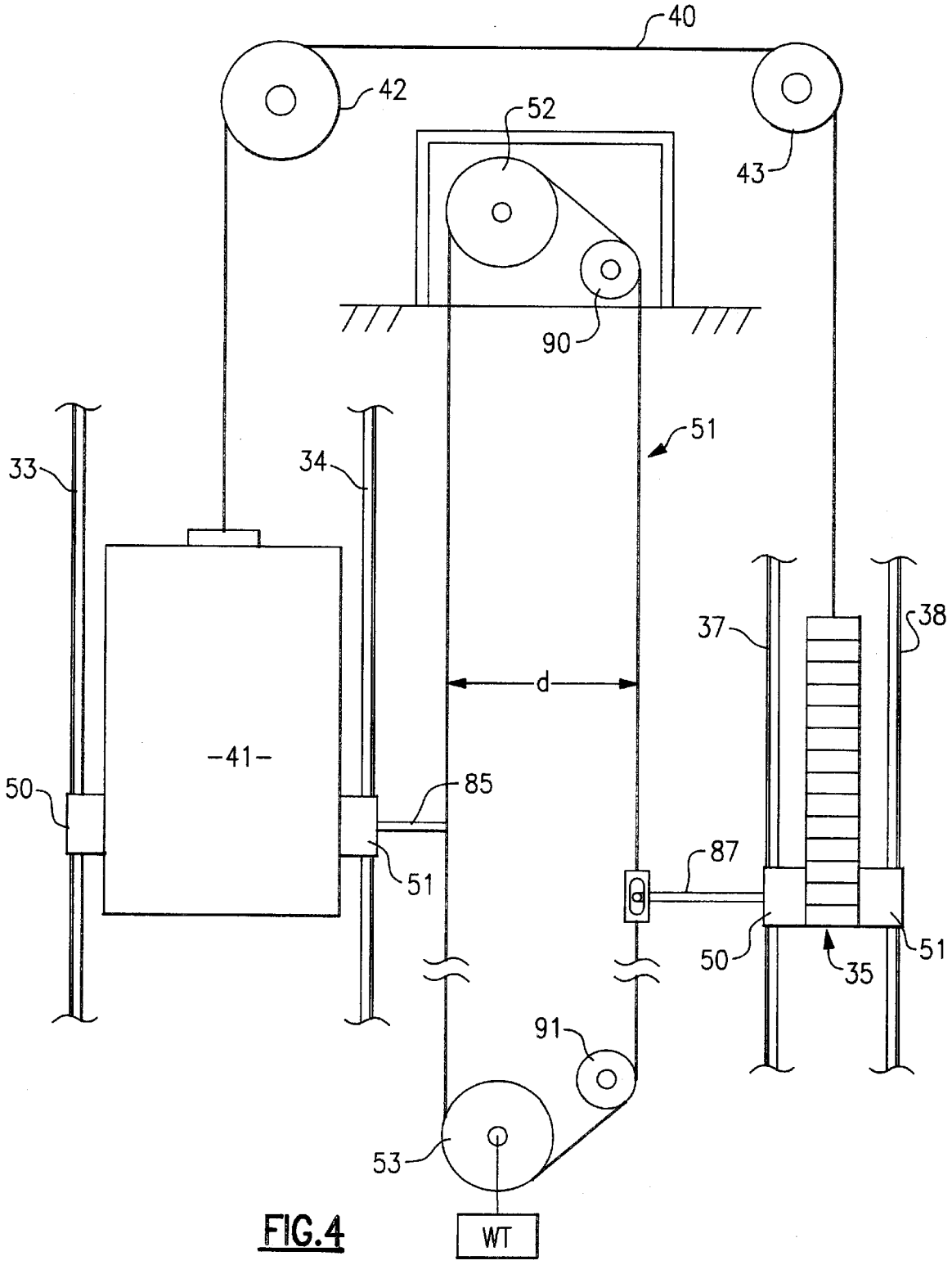
FIG. 4 is a schematic drawing of an elevator system containing a second embodiment of the present invention.
Figure 5:
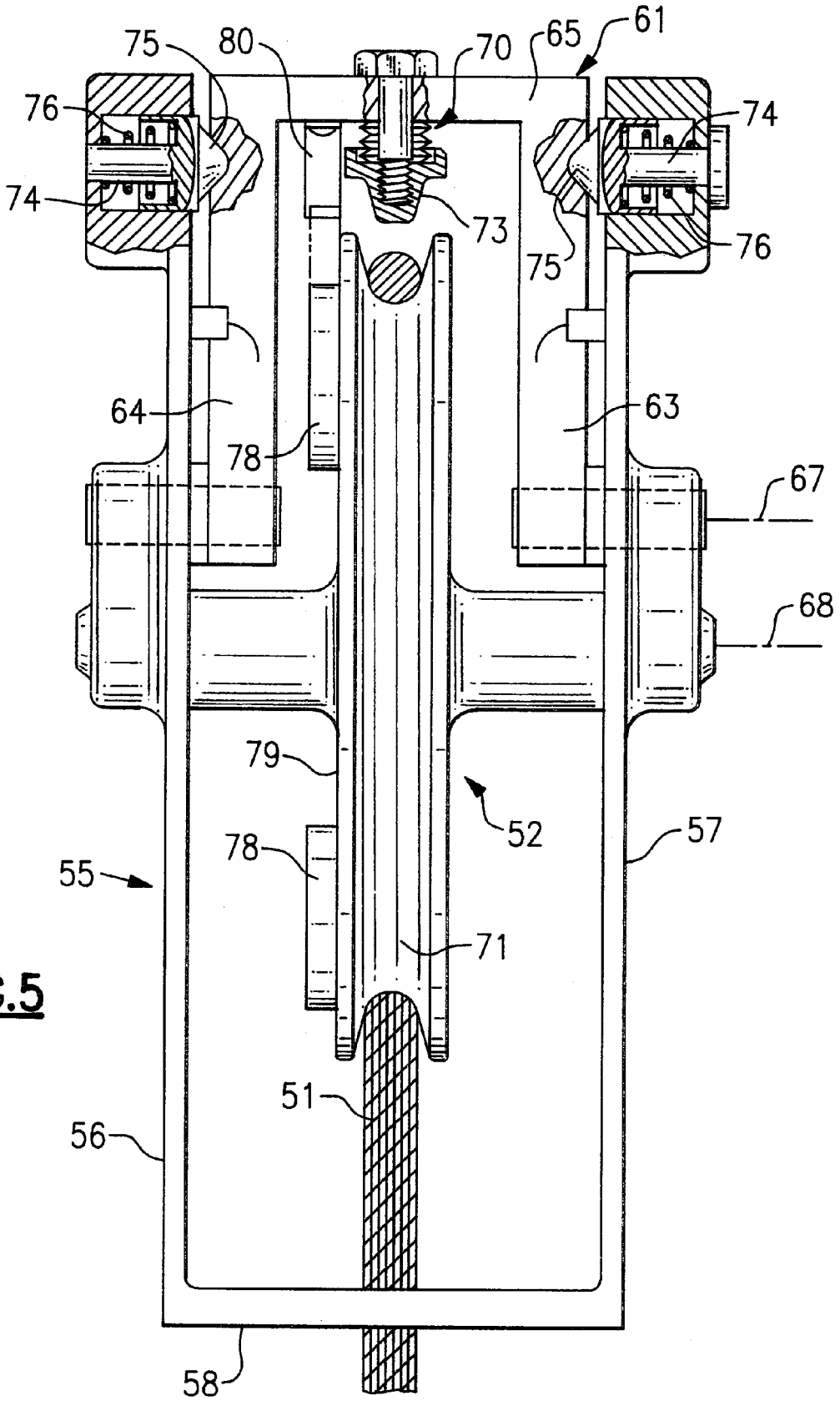
FIG. 5 is an enlarged front elevation of a governor sheave that is capable of braking the governor rope when the rope speed in either direction exceeds a given velocity.

A further embodiment of the present invention is presented in FIG. 4 wherein like reference numerals are used to identify like components previously shown in FIG. 2. Here again the cab unit 32 and the counterweight unit 35, as movably suspended in a hoist way between guide rails. The two units are connected by means of a hoist rope 40 which is trained over drive sheave 42 and idler pulley 43 so that the two units move in opposite directions at the same speed. The safeties 50 and 51 of each unit are connected to the governor rope 51 by lever arms 85 and 87 which are adapted to trip the safeties in the event an overspeed condition is detected.

Here again the upper governor sheave 52 is equipped with a bi-direction brake for slowing down the speed of the governor rope in case of as over speed in either direction.

In this embodiment of the invention, an idler pulley 90 is mounted is the machine room adjacent to upper governor sheave 52. A similar lower idler pulley 91 is mounted adjacent the lower sheave 53 in vertical alignment with the upper idler pulley so that the two opposed runs of the governor rope are mounted in parallel alignment. As can be seen, through use of this idler pulley arrangement, the horizontal distance (d) between the governor rope runs can be adjusted to accommodate for changes in the spacing between the two units. In this way, the present single rope governor can be easily and inexpensively adapted to accommodate any number of existing and new elevator systems.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. In an elevator system having a cab unit movably suspended between a first pair of guide rails and a counterweight unit movably suspended between a second pair of guide rails, safeties mounted upon both units which, when activated, brake against said guide rails, a means for connecting the two units so that they move over the guide rails at the same speed, a governor for sensing the speed of said units and activating the safeties when an over speed condition is detected that includes:

a governor rope trained over an upper sheave in an endless loop so that two parallel vertically disposed runs of rope pass downwardly between the units, means for attaching the governor rope to one of the units whereby the rope travels at the same speed as the units, a bi-directional governor brake operatively associated with said sheave for applying a braking force to the governor rope when the governor rope exceeds a given speed in either direction, a first actuator means for connecting the safeties on one unit to the governor rope, a second actuator means for attaching the safeties on the second unit to the governor rope, said first and second actuators being displaced when said governor rope is braked to trip the safeties on both of said units.

2. The governor of claim 1 wherein said brake is operatively associated with said upper sheave.

3. The governor of claim 1 wherein said first and second actuator means each include a lever arm extending between the unit and the governor rope.

4. The governor of claim 3 that further includes a link attached between two ends of said governor rope, said link containing an elongated slotted hole therein that is aligned with one run of the governor rope and one of said actuator arms being contained within said slotted hole.

5. The governor of claim 4 wherein said lever arm associated with said counterweight unit is contained within the slotted hole of said link.

6. The governor of claim 5 wherein the lever arm is arranged to freely move within the slotted hole to compensate for rope elongation.

7. The governor of claim 1 that further includes a lower tension sheave arranged so that the runs of said governor rope track along vertically disposed parallel paths of travel.

8. The governor of claim 7 wherein the governor rope is tracked over a first idler pulley horizontally offset adjacent to said upper sheave and a second idler pulley horizontally offset from the lower sheave whereby the horizontal displacement between the runs can be brought to a desired distance.

* * * * *